United States Patent [19]

Kamata

[11] 4,159,401

[45] Jun. 26, 1979

[54] GAS FILLED BUSHINGS WITH POTENTIAL SHIELDS

[75] Inventor: Isao Kamata, Sagamihara, Japan

[73] Assignee: Tokyo Shibaura Kenki K.K., Kanagawa, Japan

[21] Appl. No.: 847,428

[22] Filed: Nov. 1, 1977

[51] Int. Cl.[2] ..... H01B 17/28; H01B 17/36

[52] U.S. Cl. ..... 174/31 R; 174/143

[58] Field of Search ..... 174/19, 20, 31 R, 73 R, 174/73 SC, 142, 143

[56] References Cited

U.S. PATENT DOCUMENTS

| | | | |
|---|---|---|---|
| 3,234,322 | 2/1966 | Frowein | 174/31 R X |
| 3,849,590 | 11/1974 | Ozawa et al. | 174/31 R |

FOREIGN PATENT DOCUMENTS

| | | | |
|---|---|---|---|
| 1076216 | 2/1960 | Fed. Rep. of Germany | 174/143 |
| 2627653 | 1/1977 | Fed. Rep. of Germany | 174/31 R |
| 15815 | 4/1971 | Japan | 174/31 R |
| 456709 | 7/1968 | Switzerland | 174/31 R |

*Primary Examiner*—Laramie E. Askin

*Attorney, Agent, or Firm*—Stevens, Davis, Miller & Mosher

[57] ABSTRACT

A gas filled bushing is disclosed as comprising an outer grounded shield, an inner grounded shield and an intermediate potential shield mounted on the inner grounded shield by means of an axial insulator and extending between the inner grounded shield and a central conductor. In a modified embodiment a plurality of intermediate potential shields are disposed concentrically between the central conductor and the inner grounded shield so as to more efficiently control the potential distribution along the outer surface of the bushing.

7 Claims, 6 Drawing Figures

GAS FILLED BUSHINGS WITH POTENTIAL SHIELDS

BACKGROUND OF THE INVENTION

This invention relates to a gas filled bushing, and more particularly to a gas filled bushing of the type wherein a central conductor is supported by a bushing insulator and there are provided a grounded shield ring on the outside of the bushing insulator and a cylindrical grounded shield on the inside of the bushing insulator for the purpose of controlling the potential gradient along the outer surface of the bushing.

As shown in FIG. 1, a prior art gas filled bushing comprises a central conductor 1, a bushing insulator 2 filled with insulating gas, $SF_6$ for example, a grounded shield 4 in the form of a metal cylinder disposed in the insulating gas and concentrically surrounding the central conductor 1 and an annular ring shaped grounded shield 5 on the outside of the bushing and also concentrically surrounding the bushing insulator 2, the shields 4 and 5 acting to control or alleviate the potential gradient between the central conductor 1 and the lower flange 3 of the bushing thereby increasing the voltage rating thereof. The bushing insulator 2 is mounted on a metal pedestal 6 of an electric machine or apparatus. Another shield 7 may be provided on the upper end of the bushing.

The equipotential lines of this bushing are shown in FIG. 2. Generally, a bushing of this type is designed such that its insulating strength is higher on the inside of the bushing than on the outside. In other words, the insulating characteristic of the bushing is determined by the insulating strength on the outside and it is determined by the surface potential gradient of the grounded shield on the outside and that of the surface of the bushing near the grounded side. For this reason, it is possible to improve the insulating strength of the bushing by concentrating the equipotential lines near the high potential side so as to decrease the potential gradient along the bushing surface. This can be accomplished by disposing the cylindrical grounded shield 4 closer to the high potential side. Although this construction alleviates the potential gradient along the exterior surface of the bushing, it increases the potential gradient along the internal surface of the bushing and the local potential gradient at the end of the cylindrical shield 4, thereby impairing the insulation coordination on the inside and outside of the bushing.

SUMMARY OF THE INVENTION

Accordingly, it is an object of this invention to provide an improved gas filled bushing having a simple and inexpensive construction and an improved potential distribution along the outer surface of the bushing.

According to this invention there is provided a gas filled bushing of the type comprising a bushing insulator, a central conductor extending along the axis of the bushing insulator, a cylindrical grounded shield disposed in the bushing insulator about the central conductor, and a grounded shield mounted on the outside of the bushing insulator, characterized in that there are provided an insulator with one end secured to one end of the grounded shield, and a cylindrical intermediate potential shield with one end secured to the other end of the insulator and extending between the central conductor and the grounded shield.

The gas filled bushing of this invention can decrease the potential gradient along the outer surface of the bushing and has a simple construction. To further improve the potential gradient along the bushing surface, a plurality of intermediate potential shields may be provided between the grounded shield and the central conductor.

DESCRIPTION OF THE PREFERRED EMBODIMENTS

Figure 3:
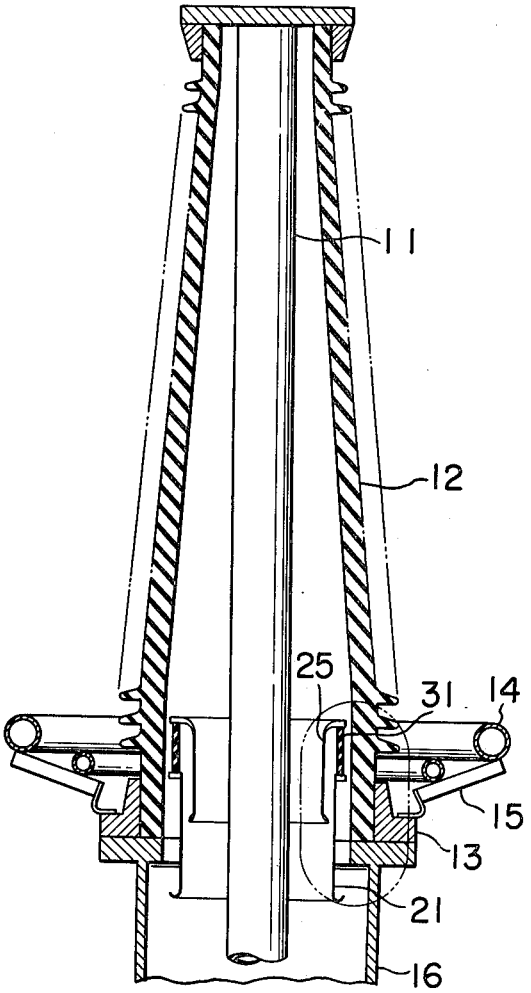
FIG. 3 is a longitudinal sectional view showing one embodiment of this invention.
Figure 4:
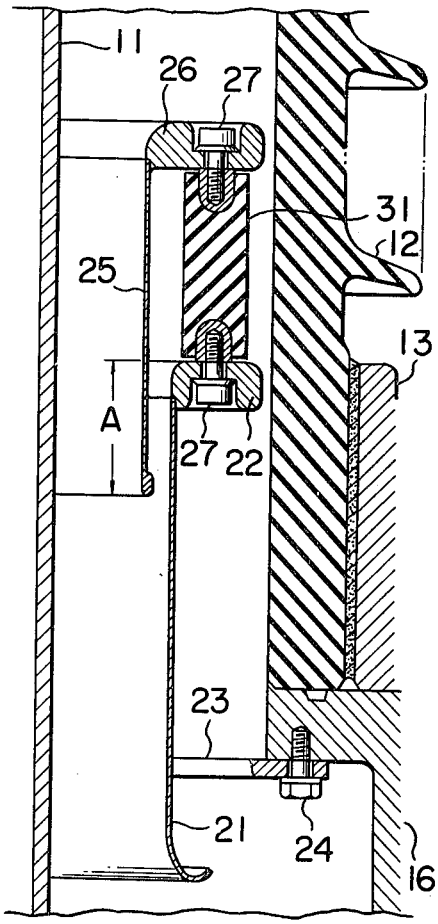
FIG. 4 is an enlarged sectional view of a portion bounded by dot and dash lines, of the bushing shown in FIG. 3.

A preferred embodiment of this invention shown in FIGS. 3 and 4 comprises a central conductor 11 supported by a bushing insulator 12 having a bottom flange 13, a cylindrical inner grounded shield 21 mounted on the inner side of the bushing insulator near flange 13, and an outside grounded shield 14 mounted on the flange 13 through supporting pipes 15. The bushing is mounted on the grounded metal pedestal 16 of an electric apparatus, for example a gas filled circuit interrupter.

As best shown in FIG. 4, a cylindrical intermediate potential metal shield 25 is mounted on the upper end of the shield 21 through pillar shaped insulators 31. An annular mounting fixture 26 is formed at the upper end of the intermediate potential shield 25 integrally therewith. The shield 21 is also provided with an annular integral mounting fixture 22 at its upper end and these annular mounting fixtures 22 and 26 are secured by bolts 27 to the opposite ends of a plurality of pillar shaped insulators 31 which are disposed on a circle about the central conductor. The mounting fixture 22 has a larger inner diameter than the mounting fixture 26 so that the shield 25 is disposed inside of the shield 21 which is electrically connected to the pedestal 16 and flange 13 via a supporting plate 23 and bolts 24. Accordingly, the potential of the intermediate shield 25 is determined by the ratio of the electrostatic capacitance between it and the central conductor 11 to that between two shields 21 and 25, that is the degree of overlapping A thereof.

Figure 2:
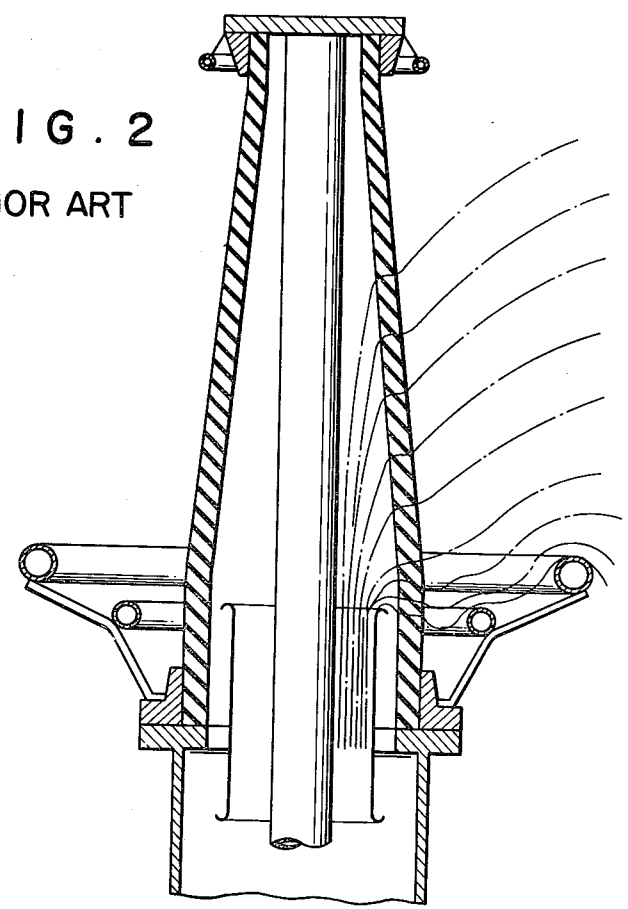
FIG. 2 PRIOR ART
FIG. 2 shows equipotential lines of the bushing shown in FIG. 1.
Figure 1:
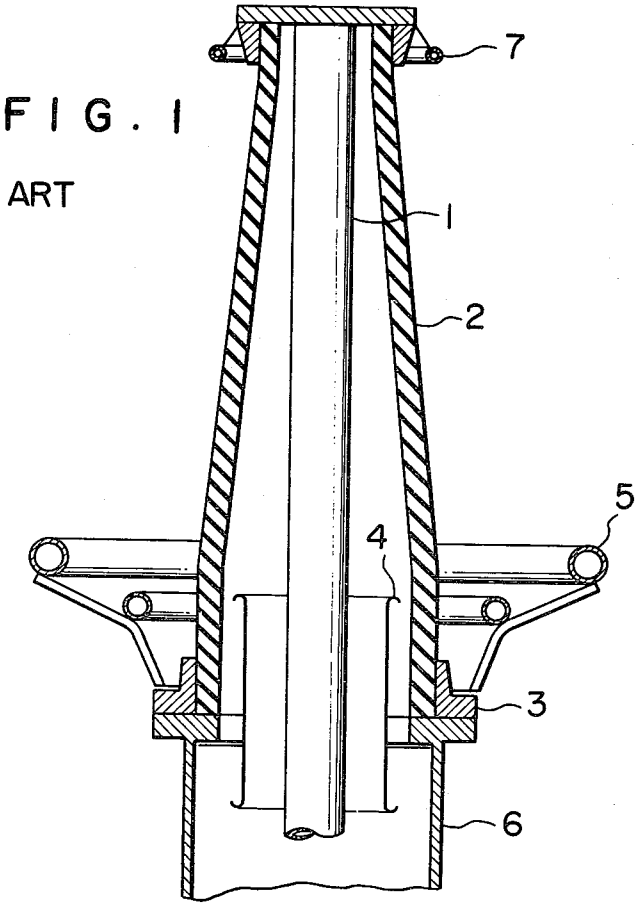
FIG. 1 PRIOR ART
FIG. 1 is a longitudinal sectional view showing a typical prior art gas filled bushing.

By providing an intermediate potential shield 25, the distribution of the equipotential lines shown in FIG. 2 is shifted toward the high potential side and since the potential difference between two shields 21 and 25 is fixed, it is possible to lower the potential gradient on the surface of the bushing. Considering the insulating strength characteristic on the bushing surface when it rains, the potential distribution along the bushing surface varies due to water drops falling thereon, but there is an advantage that the inside potential distribution is fixed by the inside intermediate potential shield.

When an intermediate potential shield is provided in the bushing, it is possible to reduce the diameter of the outside grounded shield ring from that of the conventional gas filled bushing. While the intermediate potential shield may be supported by a plurality of circumferentially spaced rod shaped radially extending insulators, such construction is difficult to ensure a desired creepage distance along the insulators. In contrast, according to this invention, since the insulators 31 are arranged to extend in the axial direction of the bushing and spaced circumferentially about shield 25, it is possible to readily obtain the desired creeping distance.

In order to maintain the intermediate potential at a desired value between 20 to 60 % of the line voltage it is necessary to position the intermediate potential shield at a definite position. However, in certain cases the inner inclined wall of the bushing insulator interferes with the upper mounting fixture. In such case the insulators 31 may be inclined with respect to the vertical by a suitable angle B as shown in FIG. 5.

Figure 6:
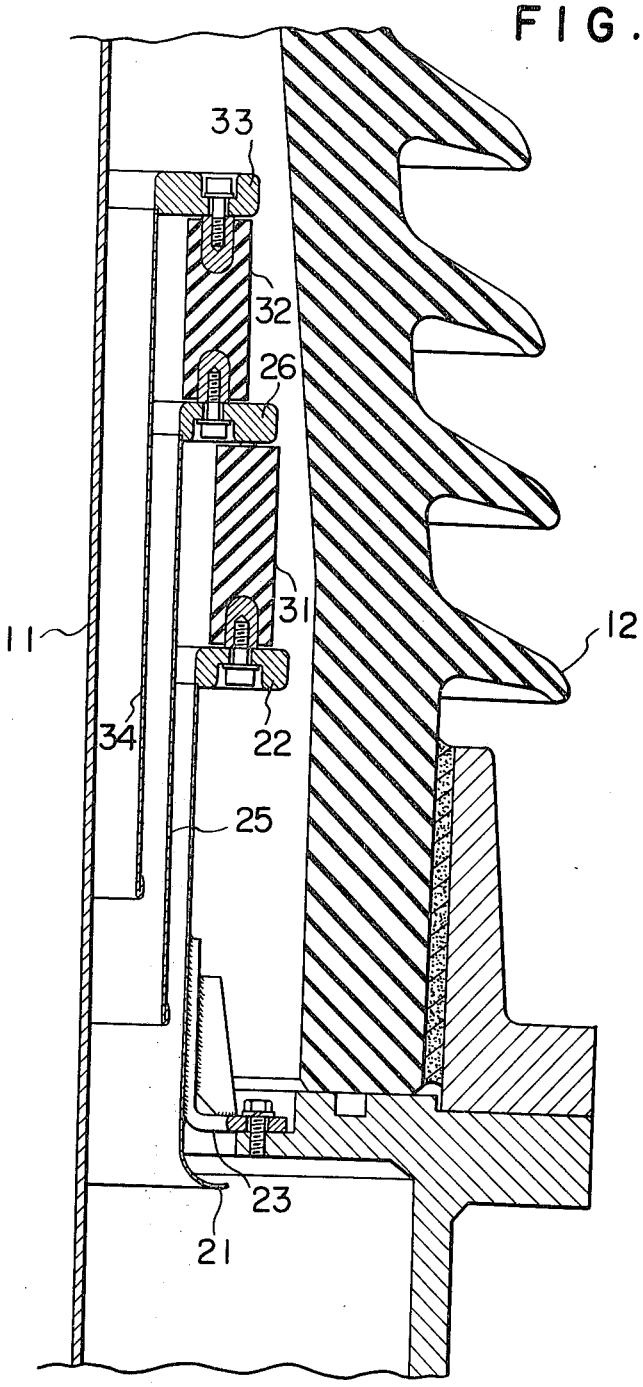
FIG. 6 is a longitudinal sectional view showing a still another modification provided with two intermediate potential shields.

When it is desired to further improve the potential distribution along the outer surface of the bushing, a plurality of stages of the intermediate potential shields 25 and 34 are used. More particularly, the shield 34 is mounted on the fixture 26 by an annular mounting fixture 33 and a plurality of circumferentially spaced pillar shaped insulators 32, as shown in FIG. 6. In this case, mounting fixture 26 is secured to the upper ends of the pillar shaped insulators 31 by bolts, not shown, interposed between adjacent pillar shaped insulators 32.

Figure 5:
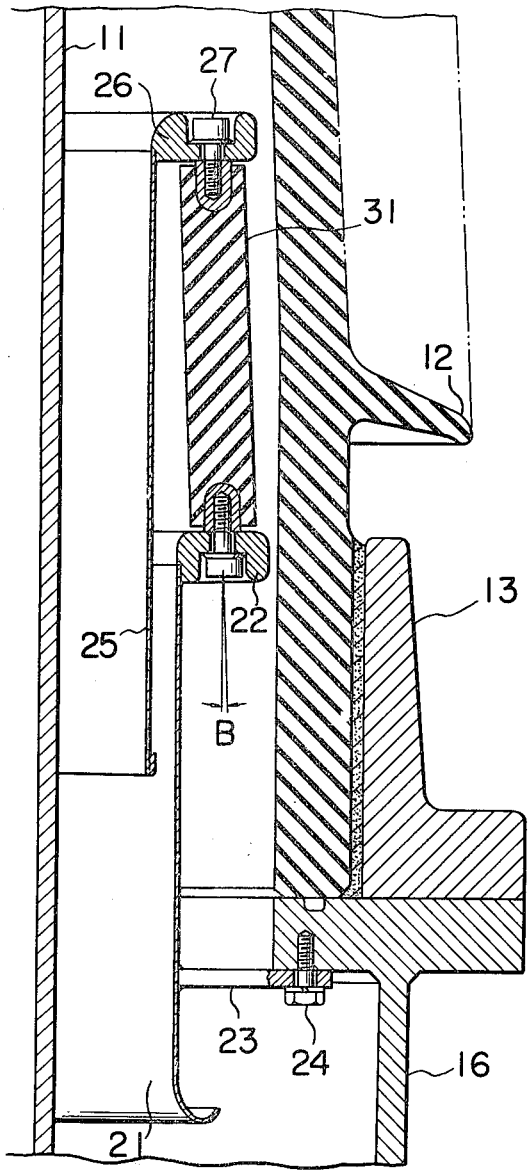
FIG. 5 is a longitudinal sectional view showing a modified embodiment of this invention.

In the embodiments shown in FIGS. 3–5, the potential of the intermediate shield is given by $$V=C_2/C_1+C_2)V_o$$

where $V_o$ represents the line voltage, $C_1$ the capacitance between the central conductor and the intermediate potential shield and $C_2$ the capacitance between it and the grounded shield. Capacitances $C_1$ and $C_2$ are determined by geometrical configurations and dimensions. If the supporting structure of the intermediate potential shield is voluminous, its capacitance and weight increase so that it is necessary to increase its mechanical strength. However, where a plurality of pillar shaped insulators are circumferentially distributed about the central conductor they do not affect the electrostatic capacitance determined by the geometrical dimensions. Moreover, such supporting structure is light and inexpensive.

In an oil filled bushing it has been known to wrap a plurality of layers of insulating paper about the central conductor and to interpose a plurality of metal layers at a plurality of radially spaced points of the lamination of paper layers. The paper layers and metal layers are wrapped such that the longitudinal sectional configuration will be a cone so as to control the potential distribution inside of the bushing. To construct such bushing, respective paper and metal layers should have different axial lengths, thus increasing the cost of manufacture. In contrast, in the gas filled bushing of this invention, the internal shields are dimensioned and disposed to mainly improve the potential distribution along the outer surface of the bushing, using a simple and inexpensive construction.

I claim:

1. A gas filled bushing comprising a bushing insulator, a central conductor extending along the axis of said bushing insulator, a cylindrical first grounded shield disposed in said bushing insulator about said central conductor, a second grounded shield mounted on the outside of said bushing insulator, a first insulator disposed within said bushing insulator with one end secured to one end of said first grounded shield and extending substantially in the axial direction of said bushing insulator, and a first cylindrical intermediate potential shield with one end secured to the other end of said first insulator and extending between said central conductor and said first grounded shield.

2. The gas filled bushing according to claim 1 wherein said first insulator comprises a plurality of pillar shaped insulators circumferentially distributed about said central conductor and electrically connected to said first grounded shield and said first intermediate shield by annular mounting fixtures respectively.

3. The gas filled bushing according to claim 2 wherein said insulators are parallel with said central conductor.

4. The gas filled bushing according to claim 2 wherein said insulators are inclined with respect to said conductor.

5. The gas filled bushing according to claim 1 which further comprises a second intermediate potential shield which is mounted on said first intermediate potential shield and extends between the same and said central conductor.

6. The gas filled bushing according to claim 5 wherein said second intermediate potential shield is mounted to said first intermediate potential shield with a second insulator.

7. The gas filled bushing according to claim 6 wherein said second insulator comprises a plurality of pillar shaped insulators circumferentially distributed about said central conductor and electrically connected to said first intermediate shield and second intermediate shield by annular mounting fixtures respectively.

* * * * *

UNITED STATES PATENT AND TRADEMARK OFFICE

CERTIFICATE OF CORRECTION

PATENT NO. : 4,159,401

DATED : June 26, 1979

INVENTOR(S) : Isao KAMATA

It is certified that error appears in the above-identified patent and that said Letters Patent are hereby corrected as shown below:

PLEASE CHANGE THE ASSIGNEE NAME FROM

"TOKYO SHIBAURA KENKI K.K." TO

"TOKYO SHIBAURA DENKI K.K."

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*